US005667278A

United States Patent [19]

Li

[11] Patent Number: 5,667,278

[45] Date of Patent: Sep. 16, 1997

[54] COMBINATIONAL CHAIR, RECLINER AND TYPING STOOL

[76] Inventor: Chun Hsien Li, P.O. Box 82-144, Taipei, Taiwan

[21] Appl. No.: 579,401

[22] Filed: Dec. 27, 1995

[51] Int. Cl.[6] ..... A47C 7/50

[52] U.S. Cl. ..... 297/423.13; 297/423.11; 297/423.12

[58] Field of Search ..... 297/423.13, 423.11, 297/423.12, 362.13, 362.12, 344.16

[56] References Cited

U.S. PATENT DOCUMENTS

| | | | |
|---|---|---|---|
| 4,765,684 | 8/1988 | Kvalheim et al. | 297/423.13 |
| 4,832,407 | 5/1989 | Serber | 297/423.13 X |
| 5,255,957 | 10/1993 | Opsvik et al. | 297/423.13 X |
| 5,490,716 | 2/1996 | Naughton | 297/423.12 |
| 5,542,746 | 8/1996 | Bujaryn | 297/423.13 X |

FOREIGN PATENT DOCUMENTS

| | | | |
|---|---|---|---|
| 961755 | 1/1975 | Canada | 297/423.12 |
| 3541120 | 5/1987 | Germany | 297/423.12 |
| 3903388 | 8/1990 | Germany | 297/423.13 |
| 2176396 | 12/1986 | United Kingdom | 297/423.12 |
| 5000275 | 1/1985 | WIPO | 297/423.13 |
| 3009701 | 5/1993 | WIPO | 297/423.13 |

*Primary Examiner*—Peter M. Cuomo
*Assistant Examiner*—Rodney B. White
*Attorney, Agent, or Firm*—Alfred Lei

[57] ABSTRACT

A combinational chair, recliner and typing stool including a base frame, a seat fixedly mounted on a fixed panel, a first linking member, a second linking member, a first adjusting rod, a fixing member fixedly mounted on a fixed panel, a supporting rod having an intermediate portion pivotally connected with the fixing member, a backrest rigidly mounted on an upper end of the supporting rod, a knee support fixedly mounted on a pair of fixed members, a first connecting member, a second connecting member, a first adjusting rod having an end pivotally connected with a lower end of the supporting rod and another end pivotally connected with the fixing member, a second adjusting rod having a lower end pivotally connected with the base frame and an upper end pivotally connected with the first linking member, and a third adjusting rod having a lower end pivotally connected with the base frame and an upper end pivotally connected with the first connecting member, whereby the chair can be easily converted into a recliner or a typing stool as desired.

2 Claims, 6 Drawing Sheets

COMBINATIONAL CHAIR, RECLINER AND TYPING STOOL

BACKGROUND OF THE INVENTION

1. Field of the Invention

This invention is related to a combinational chair, recliner and typing stool.

2. Description of the Prior Art

It has been found that the conventional chair has only one purpose and it cannot be used as a recliner or a typing stool. Furthermore, various kinds of multifunctional chairs have been developed. Nevertheless, all of their structures are quite complicated and none of them are satisfactory in use.

Therefore, it is an object of the present invention to provide a combinational chair, recliner and typing stool which can obviate and mitigate the above-mentioned drawbacks.

SUMMARY OF THE INVENTION

This invention relates to a combinational chair, recliner and typing stool.

It is the primary object of the present invention to provide a chair which can be converted into a recliner.

It is another object of the present invention to provide a chair which can be converted into a typing stool.

It is still another object of the present invention to provide a combinational chair, recliner and typing stool which is convenient and reliable in use.

It is still another object of the present invention to provide a combinational chair, recliner and typing stool which is simple and sturdy in construction.

It is a further object of the present invention to provide a combinational chair, recliner and typing stool which is fit for practical use.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
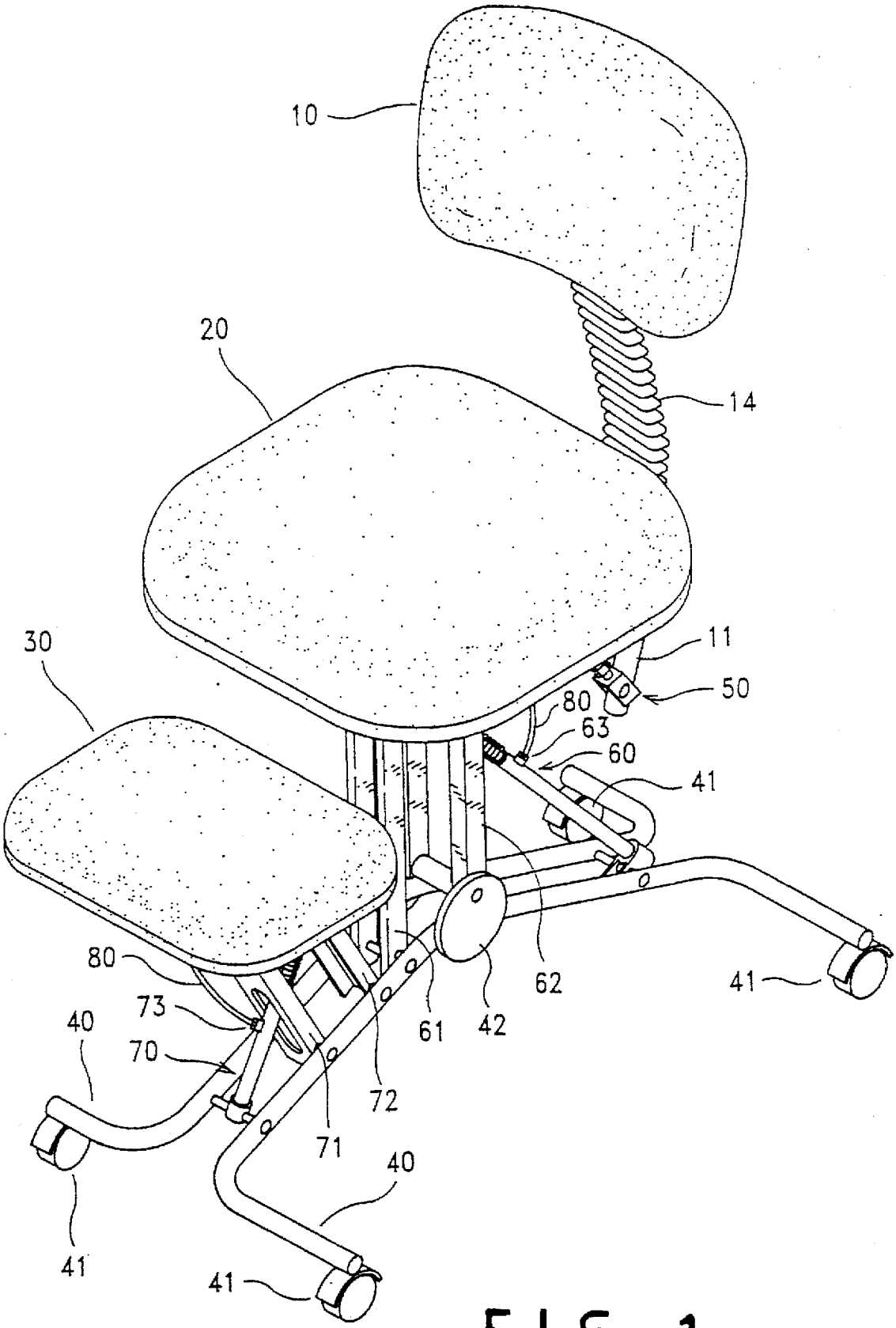
FIG. 1 is a perspective view of the present invention.

For the purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
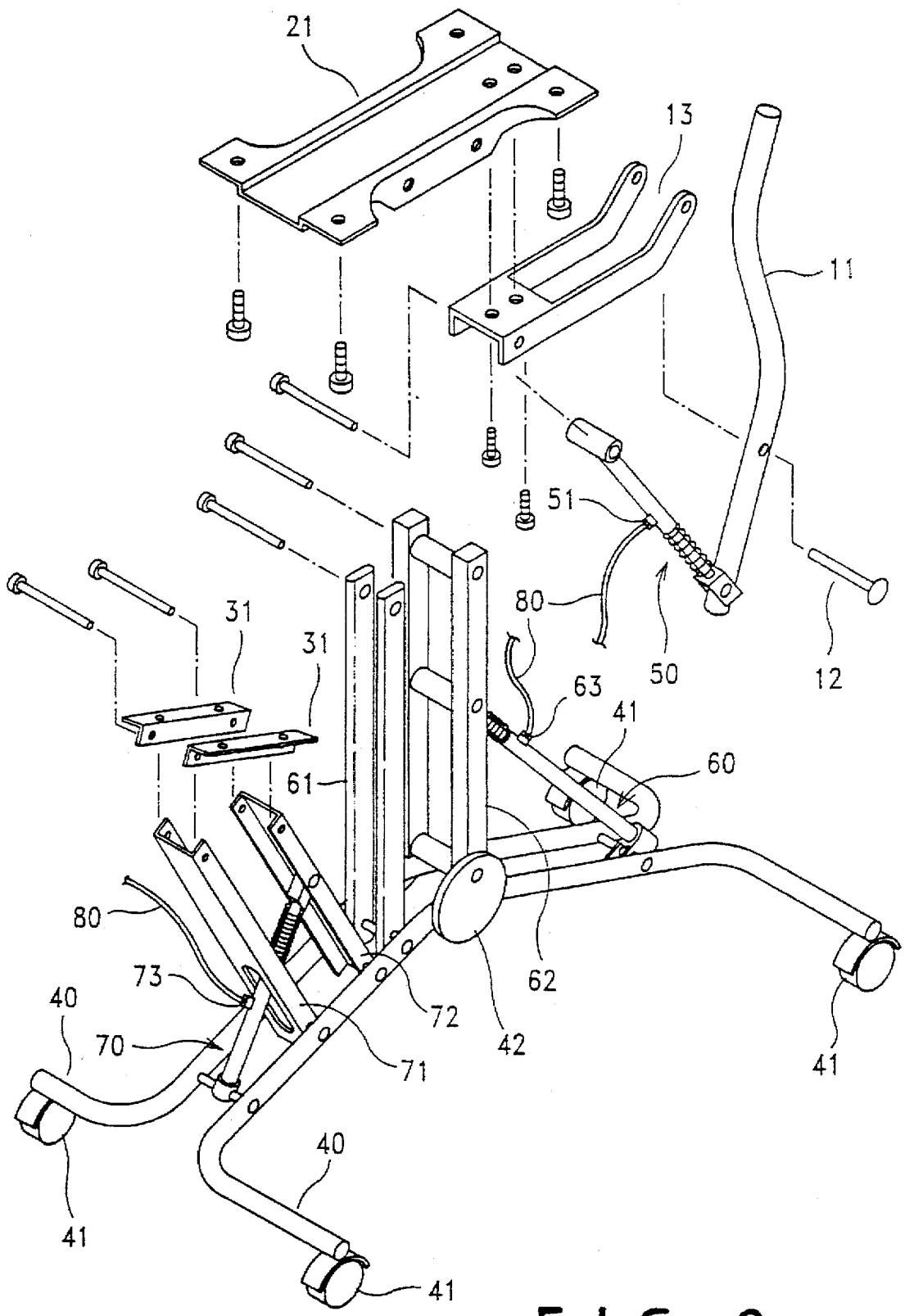
FIG. 2 is an exploded view of the present invention.
Figure 4:
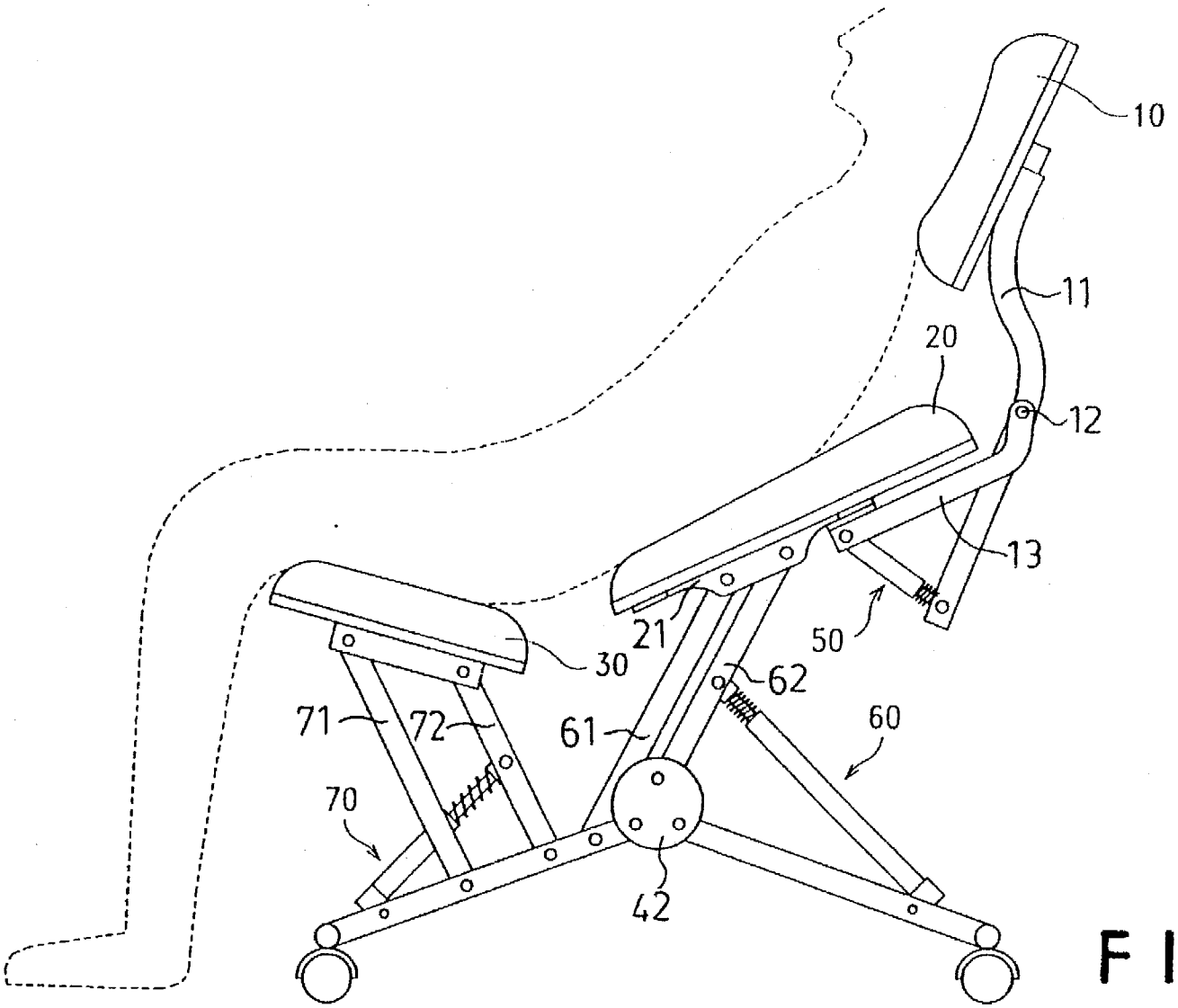
FIG. 4 illustrates how the present invention is used as a recliner.

With reference to the drawings and in particular to FIGS. 1, 2 and 4 thereof, the combinational chair, recliner and typing stool according to the present invention mainly comprises a backrest 10, a seat 20, a knee support 30, and a base frame 40. The base frame 40 includes two pairs of generally U-shaped members provided with a caster 41 at each end thereof. The supporting rod 11 for the backrest 10 is connected with an end of a fixing member 13 by a pin 12 at the intermediate portion. The seat 20 is rigidly installed on a fixed panel 21 on which is fixedly mounted the fixing member 13. A first adjusting rod 50 is pivotally connected with the lower end of the supporting rod 11 at its upper end and fixedly connected with the other end of the fixing member 13 at its lower end. The adjusting rod 50 is a telescopic member used for regulating the inclining angle of the backrest 10. Further, the adjusting rod 50 may be enclosed with a tubular member (not shown) for protection and decoration.

Between the fixed panel 21 and the base 40 there are two linking members 61 and 62. The upper ends of the linking members 61 and 62 are pivotally connected with the fixed panel 21, while the lower ends of the linking members 61 and 62 are directly pivotally connected with the base 40 and a disk 42 respectively. The disk 42 is fixedly mounted on the base 40. A second adjusting rod 60 is pivotally connected with the base 40 at its lower end and pivotally connected with the linking member 62 at its upper end. The second adjusting rod 60 is also a telescopic member for adjusting the inclining angle of the seat 20.

The knee support 30 is fixedly mounted on a pair of fixed members 31. Between the knee support 30 and the base 40 there are two connecting members 71 and 72. The uppers end of the connecting members 71 and 72 are pivotally joined with the fixed members 31, while the lower ends of the connecting members 71 and 72 are pivotally joined with the base 40. A third adjusting rod 70 is pivotally connected with the connecting member 72 at its upper end and pivotally connected with the base 40 at its lower end. The third adjusting rod 70 is also a telescopic member for adjusting the inclining angle of the knee support 30.

The adjusting rods 50, 60 and 70 are telescopic members having controlling means 51, 63 and 73 which will reduce the length of the adjusting rods when pulled by an external force. The adjusting rods 50, 60 and 70 may be of any conventional design well known to those skilled in the art and are not considered a part of the present invention.

Figure 3:
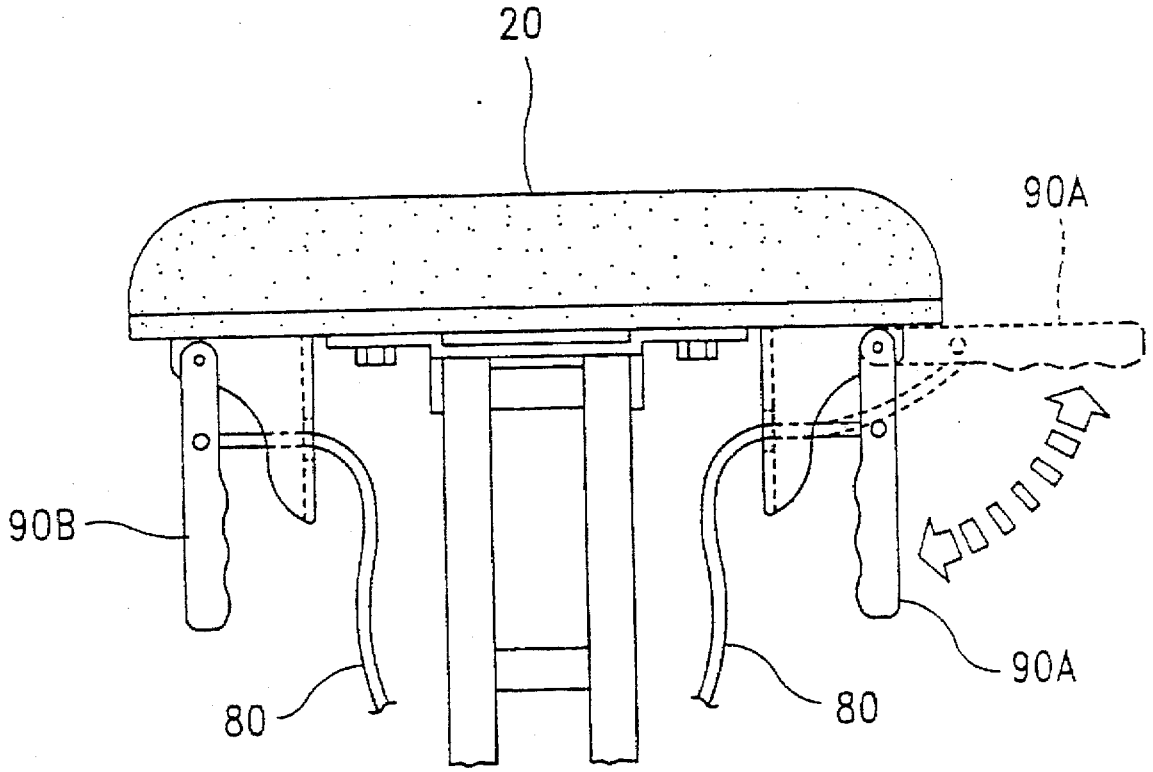
FIG. 3 illustrates the handles for connecting with the adjusting rods via a cable.

Referring to FIG. 3, the seat 20 is provided at the bottom with a pair of handles 90A and 90B which are respectively connected to the first adjusting rod 50 and the second adjusting rod 60 via a cable 80. Accordingly, the handles 90A and 90B can be used for controlling the inclination of the backrest 10 and the seat 20 respectively. Similarly, a third handle (not shown) is mounted under the knee support 30 and connected to the third adjusting rod 70 by a cable 80 so that the third handle can be used for controlling the inclination of the knee support 30.

As shown in FIG. 4, when the first and second adjusting rods 50 and 60 are regulated to their shortest length and the the third adjusting rod 70 is regulated to its longest length, the backrest 10, the seat 20 and the knee support 30 will be disposed at a position suitable for an occupant to recline thereon. In the meantime, the seat 20 is oriented at an angle of 25 degrees with respect to the horizontal plane, while the knee support 30 is disposed at an angle of 15 degrees with respect to the horizontal plane.

Figure 5:
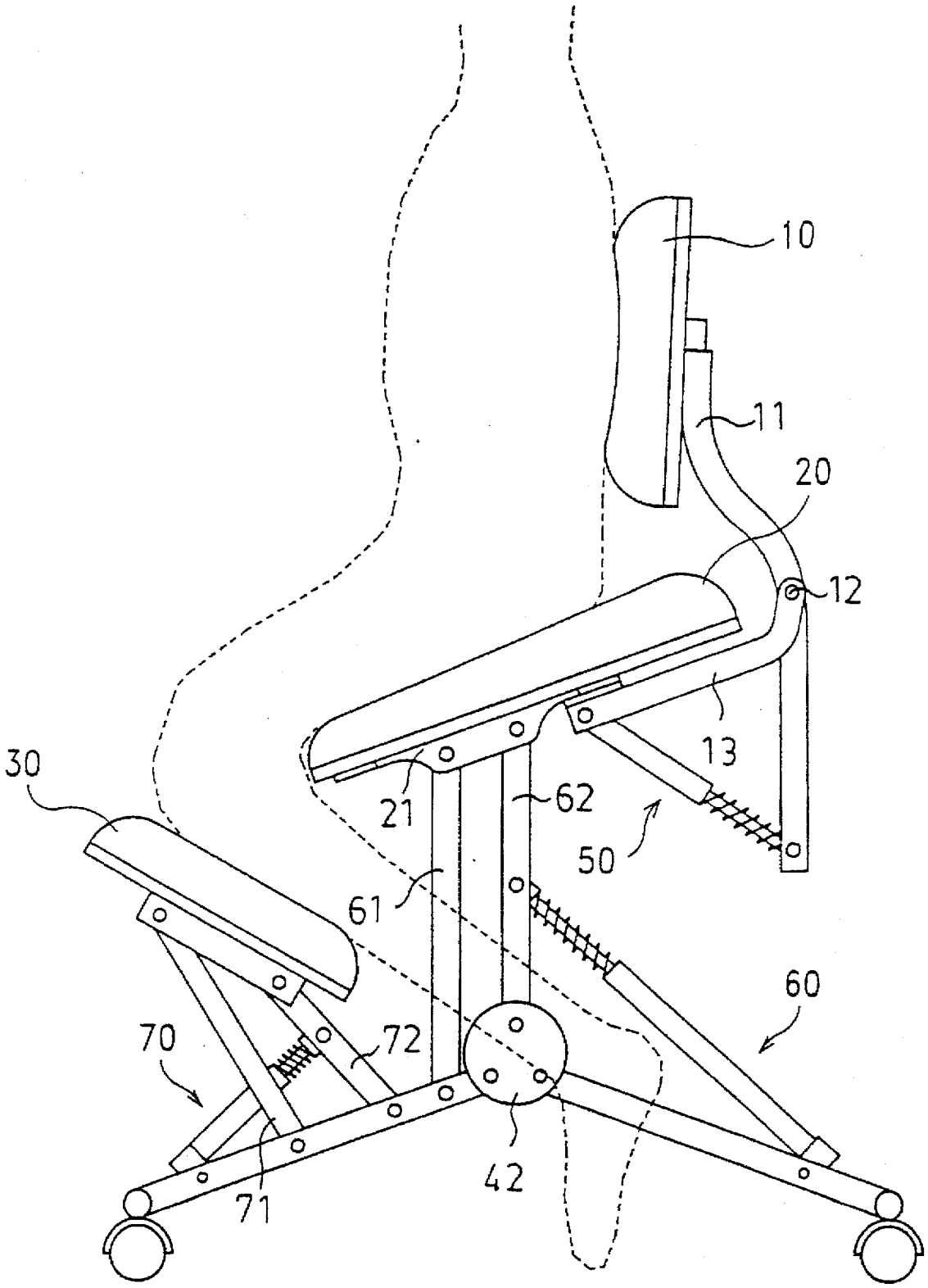
FIG. 5 illustrates how the present invention is used as a typing stool.

As can be seen in FIG. 5, the present invention can be conveniently converted into a typing stool by regulating the second adjusting rod 60 to a suitable length and the third adjusting rod 70 to its shortest length. The inclination of the backrest 10 may be controlled by regulating the length of the first adjusting rod 50. Meanwhile, the seat 20 is oriented at an angle of 20 degrees with respect to the horizontal plane, while the knee support 30 makes an angle of 30 degrees relative to the horizontal plane.

Figure 6:
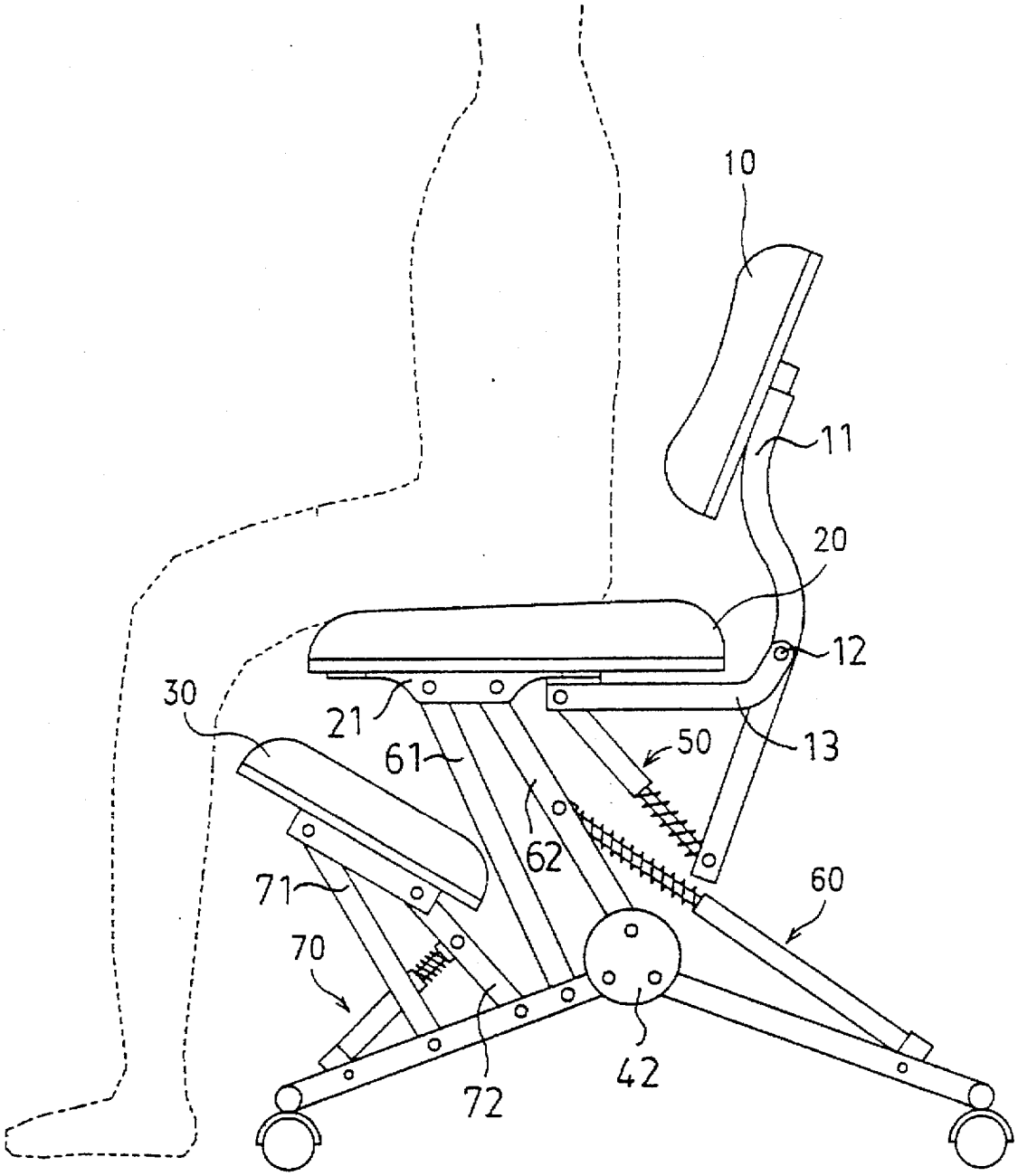
FIG. 6 illustrates how the present invention is used as a chair.

As illustrated in FIG. 6, the second adjusting rod 60 is adjusted to its longest length and the third adjusting rod 70 adjusted to its shortest length so as to make the present invention as a chair. The inclination of the backrest 10 may be regulated by the first adjusting rod 50. The seat 20 is disposed at a horizontal position, while the knee support 30 makes an angle of 30 degrees with respect to the horizontal plane.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A combinational chair, recliner and typing stool comprising:

a base frame;

a seat fixedly mounted on a fixed panel;

a first linking member having a lower end pivotally connected with said base frame and an upper end pivotally connected with said fixed panel;

a second linking member having a lower end pivotally connected with said base frame and an upper end pivotally connected with said fixed panel and located at one side of said first linking member;

a first adjusting rod having a lower end pivotally connected with said base frame and an upper end pivotally connected with said first linking member;

a fixing member fixedly mounted on said fixed panel;

a supporting rod having an intermediate portion pivotally connected with said fixing member;

a backrest rigidly mounted on an upper end of said supporting rod;

a knee support fixedly mounted on a pair of fixed members;

a first connecting member having an upper end pivotally connected with fixed members and a lower end pivotally connected with said base frame;

a second connecting member having an upper end pivotally connected with fixed members and a lower end pivotally connected with said base frame and located at one side of said first connecting member;

a first adjusting rod having an end pivotally connected with a lower end of said supporting rod and another end pivotally connected with said fixing member;

a second adjusting rod having a lower end pivotally connected with said base frame and an upper end pivotally connected with said first linking member; and a third adjusting rod having a lower end pivotally connected with said base frame and an upper end pivotally connected with said first connecting member.

2. The combinational chair, recliner and typing stool as claimed in claim 1, wherein said base frame is provided with casters.

* * * * *